US011238806B2

(12) United States Patent
Park et al.

(10) Patent No.: US 11,238,806 B2
(45) Date of Patent: Feb. 1, 2022

(54) DISPLAY DEVICE

(71) Applicant: Samsung Display Co., Ltd., Yongin-si (KR)

(72) Inventors: Yong Sung Park, Yongin-si (KR); Won Jang Ki, Yongin-si (KR); Dae Hyun Noh, Yongin-si (KR); Min Su Lee, Yongin-si (KR); Seung Bin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/779,343

(22) Filed: Jan. 31, 2020

(65) Prior Publication Data

US 2020/0302875 A1 Sep. 24, 2020

(30) Foreign Application Priority Data

Mar. 19, 2019 (KR) ..... 10-2019-0031301

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/08* (2013.01); *G09G 2320/0233* (2013.01); *G09G 2320/0257* (2013.01)

(58) Field of Classification Search
CPC ..... G09G 3/3266; G09G 3/3275; G09G 2320/0233; G09G 2320/0257; G09G 2310/08; G09G 2360/16; G09G 2310/0213; G09G 2310/067; G09G 3/3233; G09G 2300/0819; G09G 2300/0842; G09G 2300/0861; G09G 2320/0238; G09G 3/3208; G09G 3/32; G09G 2320/0626
See application file for complete search history.

(56) References Cited

U.S. PATENT DOCUMENTS

2003/0016189 A1* 1/2003 Abe ..... G09G 3/2014 345/55
2005/0017994 A1* 1/2005 Oh ..... G09G 3/3406 345/691
2007/0210996 A1* 9/2007 Mizukoshi ..... G09G 3/3233 345/77
2013/0207956 A1* 8/2013 Jang ..... G09G 3/3266 345/212
2016/0148569 A1* 5/2016 Park ..... G09G 3/3233 345/212

FOREIGN PATENT DOCUMENTS

JP 2005-208259 A 8/2005
KR 10-2018-0060530 A 6/2018

* cited by examiner

*Primary Examiner* — Mark W Regn
(74) *Attorney, Agent, or Firm* — Lewis Roca Rothgerber Christie LLP

(57) ABSTRACT

A display device includes: a display panel including a plurality of pixels; a scan driver configured to supply a scan signal to the pixels through a scan line; and a timing controller configured to control a pulse width of the scan signal according to a display luminance of the display panel.

16 Claims, 9 Drawing Sheets

DISPLAY DEVICE

CROSS-REFERENCE TO RELATED APPLICATION

The present application claims priority to and the benefit of Korean Patent Application No. 10-2019-0031301, filed Mar. 19, 2019, the entirety of which is hereby incorporated by reference for all purposes as if fully set forth herein.

BACKGROUND

1. Field

Aspects of some example embodiments relate to an electronic device, and for example, to a display device.

2. Discussion

A display device may include pixels that emit light in response to a data signal, and a scan driver that outputs a scan signal to write the data signal to the pixels. When a grayscale level (i.e., a data voltage) varies suddenly between consecutive frames, some pixels may emit insufficient light or fail to reach the desired grayscale level or luminance and a display failure such as screen dragging, afterimage, image blur, etc. may be visually recognized.

The above information disclosed in this Background section is only for enhancement of understanding of the background and therefore it may contain information that does not constitute prior art.

SUMMARY

Some example embodiments of the present invention may provide a display device in which a pulse width of a scan signal is controlled according to a display luminance of a display panel.

The characteristics of the present invention are not limited to the above-mentioned characteristics. The characteristics of the present invention may be variously extended or changed without departing from the spirit and scope of the present invention.

According to some example embodiments of the present invention, a display device may include: a display panel including a plurality of pixels; a scan driver for supplying a scan signal to each of the plurality of pixels through a scan line; and a timing controller for controlling a pulse width of the scan signal according to a display luminance of the display panel.

According to some example embodiments, the scan driver may output the scan signal having a first pule width corresponding to a first display luminance and output the scan signal having a second pule width corresponding to a second display luminance lower than the first display luminance.

According to some example embodiments, the second pulse width may be shorter than the first pulse width.

According to some example embodiments, the pulse width of the scan signal may be decreased as the display luminance decreases.

According to some example embodiments, when the display luminance is higher than a predetermined reference luminance, the scan driver may output the scan signal having a first pulse width.

According to some example embodiments, when the display luminance is equal to or lower than the predetermined reference luminance, the scan driver may output the scan signal having a second pulse width shorter than the first pulse width.

According to some example embodiments, when the display luminance is equal to or lower than the predetermined reference luminance, the pulse width of the scan signal may be varied.

According to some example embodiments, when the display luminance is equal to or lower than the predetermined reference luminance, the pulse width of the scan signal may be decreased as the display luminance decreases.

According to some example embodiments, the scan driver may determine the pulse width of the scan signal based on a width of a gate-on period of a clock signal supplied from the timing controller.

According to some example embodiments, the timing controller may output the clock signal having the gate-on period of a first pulse width corresponding to the first display luminance, and output the clock signal having the gate-on period of a second pulse width corresponding to the second display luminance lower than the first display luminance.

According to some example embodiments, the second pulse width may be shorter than the first pulse width.

According to some example embodiments, the width of the gate-on period of the clock signal may be decreased as the display luminance decreases.

According to some example embodiments, the timing controller may convert the display luminance into a luminance level of a digital value and output the clock signal having the gate-on period corresponding to the luminance level.

According to some example embodiments, the display device may further comprise: a data driver for supplying a data signal to each of the plurality of pixels through a data line; and an emission driver for supplying an emission control signal to each of the plurality of pixels through an emission control line.

According to some example embodiments, when the display luminance is equal to or lower than the predetermined reference luminance, a gate-off period of the emission control signal may be varied according to the display luminance.

According to some example embodiments, when the display luminance is equal to or lower than the predetermined reference luminance, the display luminance may be decreased as a width of the gate-off period of the emission control signal increases.

BRIEF DESCRIPTION OF THE DRAWINGS

The accompanying drawings, which are included to provide a further understanding of the inventive concepts, and are incorporated in and constitute a part of this specification, illustrate aspects of some example embodiments of the inventive concepts, and, together with the description, serve to explain some example characteristics of the inventive concepts.

DETAILED DESCRIPTION

Figure 1:
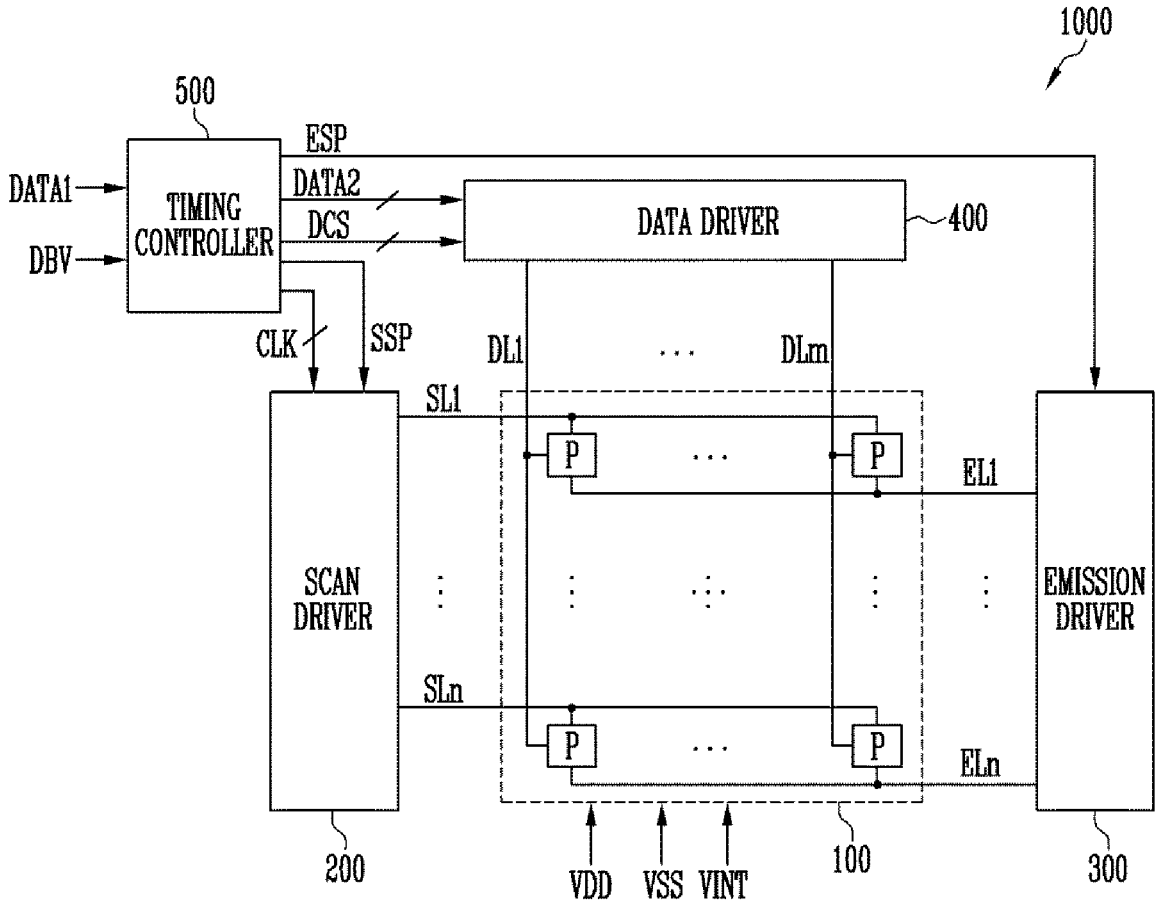
FIG. 1 is a block diagram illustrating a display device according to some example embodiments of the present invention.

Aspects of some example embodiments of the present invention will now be described in more detail with reference to the accompanying drawings. The same reference numerals are used for the same constituent elements in the drawings and redundant explanations for the same constituent elements are omitted.

FIG. 1 is a block diagram illustrating a display device according to some example embodiments of the present invention.

Referring to FIG. 1, a display device 1000 may include a display panel 100, a scan driver 200, an emission driver 300, a data driver 400, and a timing controller 500.

The display panel 100 may display an image. The display panel 100 may include a plurality of scan lines SL1 to SLn, a plurality of data lines DL1 to DLm, a plurality of emission control lines EL1 to ELn, and a plurality of pixels PX connected to the plurality of scan lines SL1 to SLn, the plurality of data lines DL1 to DLm, and the plurality of emission control lines EL1 to ELn.

According to some example embodiments of the present invention, the number of scan lines SL1 to SLn and the number of emission control lines EL1 to ELn each may be n, wherein n may be a natural number. The number of data lines DL1 to DLm may be m, wherein m may be a natural number. Accordingly, the number of pixels PX may be n×m. The display panel 100 may receive a first power source voltage VDD and a second power source voltage VSS from an outside, for example, a power supply unit. According to some example embodiments, the display panel 100 may further receive a third power source voltage (or an initialization power source voltage) VINT.

The timing controller 500 may receive an input control signal and input image data DATA1 from an image source such as an external graphic device. The timing controller 500 may generate image data DATA2 according to an operation condition of the display panel 100 and provide the image data DATA2 to the data driver 400 based on the input image data DATA1. The timing controller 500 may generate a scan drive control signal for controlling a drive timing of the scan driver 200, an emission drive control signal for controlling a drive timing of the emission driver 300, and a data drive control signal DCS for controlling a drive timing of the data driver 400 based on the input control signal, and may provide the scan drive control signal, the emission drive control signal and the data drive control signal DCS to the scan driver 200, the emission driver 300 and the data driver 400, respectively.

The scan drive control signal may include a scan start signal SSP and clock signals CLK. The scan start signal SSP may control a first timing of the scan signal. The clock signals CLK may be used to shift the scan start signal SSP.

The emission drive control signal may include an emission control start signal ESP and clock signals. The emission control start signal ESP may control a first timing of the emission control signal. The clock signals may be used to shift the emission control start signal ESP.

According to some example embodiments, the timing controller 500 may receive a luminance level DBV corresponding to a display luminance. The display luminance may be a luminance of the image displayed on the display panel 100. The display luminance may be determined by a setting of a user, or by a processor of the display device. The luminance level DBV may be a value obtained by converting the display luminance into a digital value. Alternatively, the timing controller 500 may receive a signal corresponding to the display luminance and convert the signal into the digital luminance level DBV. For example, the display luminance of up to about 650 nits may be divided into 8-bit luminance levels DBV. However, this is merely an example, and a maximum luminance of the display luminance and the luminance level DBV are not limited thereto.

The timing controller 500 may generate the clock signal CLK having a gate-on period corresponding to the luminance level DBV and provide the clock signal CLK to the scan driver 200. According to some example embodiments, a width of the gate-on period of the clock signal CLK may be decreased as the luminance level DBV (e.g., display luminance) decreases. Here, the gate-on period may be a period in which the clock signal CLK has a gate-on voltage level, and the gate-on voltage level may be a logic level that turns on a transistor receiving the clock signal CLK. For example, when the transistor is a p-type transistor, the gate-on voltage level may be a logic low level.

The scan driver 200 may receive the scan drive control signal (including the scan start signal SSP and the clock signal CLK) from the timing controller 500. The scan driver 200 may supply scan signals to the scan lines SL1 to SLn in response to the scan drive control signal. A pulse width of the scan signal may be adjusted corresponding to the gate-on period of the clock signal CLK.

According to some example embodiments, the scan driver 200 may output a scan signal having a first pulse width corresponding to a first display luminance (or a first luminance level), and a scan signal having a second pulse width corresponding to a second display luminance (or a second luminance level) lower than the first display luminance. At this time, the second pulse width may be shorter than the first pulse width.

According to some example embodiments, as the display luminance decreases, the pulse width of the scan signal may be decreased. The pulse width of the scan signal may be a width of a period in which the scan signal has a gate-on level.

The emission driver 300 may receive the emission drive control signal (including the emission control start signal ESP) from the timing controller 500. The emission driver 300 may supply the emission control signal to the emission control lines EL1 to ELn in response to the emission drive control signal.

The data driver 400 may receive the data drive control signal DCS and the image data DATA2 from the timing controller 500. The data driver 400 may supply a data signal (a data voltage) having analog form to the data lines DL1 to DLm in response to the data drive control signal DCS. The data signal supplied to the data lines DL1 to DLm may be supplied to the pixels P selected by the scan signal.

As described above, the display device 1000 according to some example embodiments of the present invention may adjust the pulse width of the scan signal according to the display luminance (e.g., the luminance level DBV).

Figure 2:
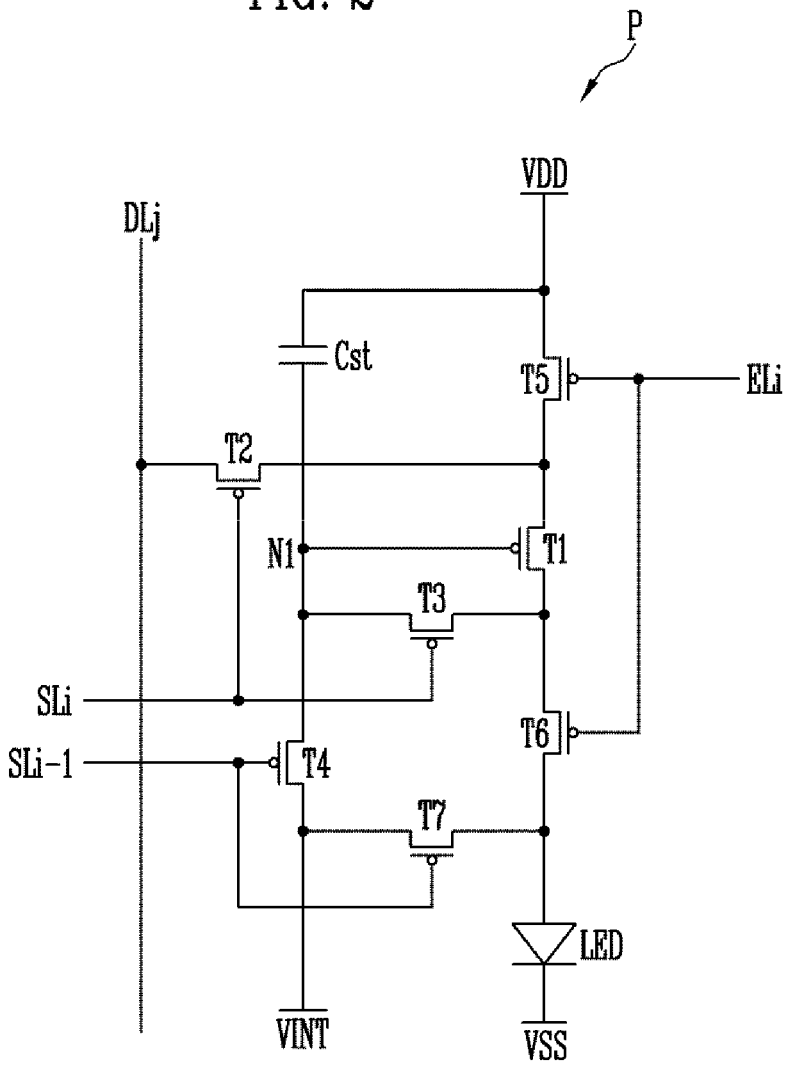
FIG. 2 is a circuit diagram illustrating an example of a pixel included in the display device of FIG. 1.

FIG. 2 is a circuit diagram illustrating an example of the pixel included in the display device of FIG. 1.

Referring to FIGS. 1 and 2, the pixel P may include first to seventh transistors T1 to T7, a light emitting device LED, and a storage capacitor Cst. Here, the pixel P arranged in a j-th column (where j is a natural number) and an i-th row (wherein i is a natural number greater than 1) will be described as an example.

Although the first to seventh transistors T1 to T7 are shown as p-type transistors (for example, p-channel metal oxide semiconductor (PMOS) transistors) in FIG. 2, the first to seventh transistors T1 to T7 are not limited thereto. For example, at least one of the first to seventh transistors T1 to T7 may be an n-type transistor.

The first transistor T1 may be electrically coupled between the first power source voltage VDD and the light emitting device LED. The first transistor T1 may include a gate electrode coupled to a first node N1. The first transistor T1 may determine the magnitude of a driving current flowing to the light emitting device LED according to the magnitude of the data voltage (the data signal).

The second transistor T2 may be a scan transistor for transmitting the data voltage to the pixel P according to the scan signal supplied to an i-th scan line SLi. The second transistor T2 may be coupled between a j-th data line DLj and a first electrode (e.g., a source electrode) of the first transistor T1. A gate electrode of the second transistor T2 may be connected to the i-th scan line SLi.

The third transistor T3 may perform data voltage writing and threshold voltage compensation for the first transistor T1. The third transistor T3 may be coupled between a second electrode (e.g., a drain electrode) of the first transistor T1 and the first node N1. A gate electrode of the third transistor T3 may be connected to the i-th scan line SLi. When the second transistor T2 and the third transistor T3 are turned on by the scan signal (the i-th scan signal), the first transistor T1 may be diode-connected and a threshold voltage of the first transistor T1 may be compensated.

The fourth transistor T4 may be coupled between the first node N1 and a conductive line transmitting the initialization power source voltage VINT. The fourth transistor T4 may include a gate electrode connected to an (i−1)th scan line SLi−1. When the fourth transistor T4 is turned on, the initialization power source voltage VINT may be supplied to the gate electrode of the first transistor T1. For example, the initialization power source voltage VINT may be an initialization voltage for initializing a gate voltage of the first transistor T1.

The fifth transistor T5 may be coupled between a power supply line for transmitting the first power source voltage VDD and the first electrode of the first transistor T1. The fifth transistor T5 may include a gate electrode connected to an i-th emission control line ELi.

The sixth transistor T6 may be coupled between a second electrode of the first transistor T1 and a first electrode (e.g., an anode) of the light emitting device LED. The sixth transistor T6 may include a gate electrode connected to the i-th emission control line ELi.

The fifth and sixth transistors T5 and T6 may be turned on in response to the emission control signal. A driving current may be supplied to the light emitting device LED by turning on the fifth and sixth transistors T5 and T6. The light emitting device LED may emit light at a grayscale level corresponding to the driving current.

The seventh transistor T7 may be coupled between the first electrode of the light emitting device LED and the conductive line transmitting the initialization power source voltage VINT. The seventh transistor T7 may include a gate electrode connected to the (i−1)th scan line SLi−1. When the seventh transistor T7 is turned on, the initialization power source voltage VINT may be transmitted to the first electrode of the light emitting device LED.

The light emitting device LED may be connected between a second electrode of the sixth transistor T6 and the second power source voltage VSS. According to some example embodiments, the first power source voltage VDD may be greater than the second power source voltage VSS. The light emitting device LED may be an organic light emitting diode including an organic light emitting layer. According to some example embodiments, the light emitting device LED may be an inorganic light emitting device, a light emitting device including a plurality of nano light emitting diodes, or a light emitting device that emits light using a quantum dot effect.

When the scan signal is supplied to the third transistor T3 for a sufficient time, a voltage (for example, a first gate voltage) corresponding to a difference between the data voltage and the threshold voltage (an absolute value of the threshold voltage) of the first transistor T1 may be supplied to the first node N1 by the diode-connected first transistor T1. However, when the pulse width of the scan signal becomes short, the threshold voltage compensation of the first transistor is not completely performed and a second gate voltage lower than the first gate voltage for the same data voltage may be supplied to the first node N1. Therefore, the driving current (or the compensated current) flowing through the first transistor T1 may be increased.

On the other hand, when a screen is changed from an image of a black grayscale level (low grayscale image) to an image of a white grayscale level (a high grayscale image) to an abrupt grayscale level change, a step efficiency, which is a ratio of a grayscale level (e.g., an actual grayscale level of a first frame after screen changing) immediately after a screen changing to a target grayscale level (e.g., an ideal luminance) of a current image immediately after the screen changing, may be lowered due to a parasitic capacitance of the light emitting device LED or the like. For example, the lower the display luminance is, the more image defects such as an afterimage due to the lowered step efficiency may be visually recognized.

The display device according to some example embodiments of the present invention may increase the driving current of the first transistor T1 by decreasing the pulse width of the scan signal supplied to the second and third transistors T2 and T3 as the luminance decreases. Therefore, the step efficiency may be improved when the screen is changed from a low grayscale level to a high grayscale level.

Figure 3:
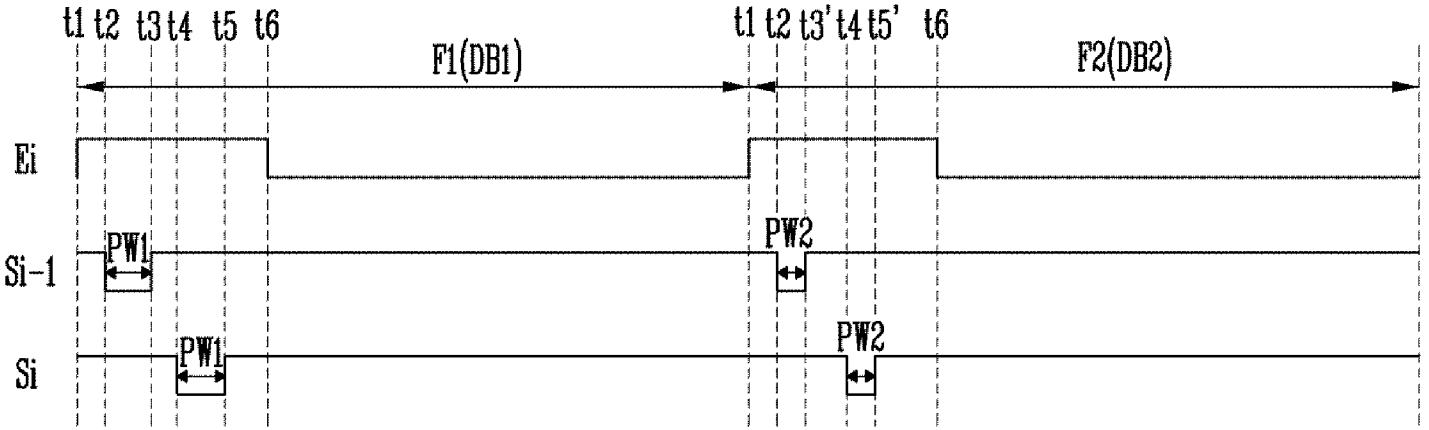
FIG. 3 is a timing chart illustrating an example of signals supplied to the pixel of FIG. 2.

FIG. 3 is a timing chart illustrating an example of signals supplied to the pixel of FIG. 2.

Referring to FIGS. 1, 2 and 3, pulse widths of scan signals Si−1 and Si of a first frame F1 and scan signals Si−1 and Si of a second frame F2 may be different from each other.

The timing chart of FIG. 3 shows signals supplied to the pixel P arranged in an i-th pixel row and connected to the i-th scan line SLi and the (i−1)th scan line SLi−1. The i-th scan signal Si may be supplied to the i-th scan line SLi and the (i−1)th scan signal Si−1 may be supplied to the (i−1)th scan line SLi−1. In addition, an i-th emission control signal Ei may be supplied to the i-th emission control line ELi.

The display device 1000 in the first frame F1 may emit light with a first display luminance DB1 and the display device 1000 in the second frame F2 may emit light with a second display luminance DB2 lower than the first display luminance DB1. For example, the first display luminance DB1 may be about 50 nits, and the second display luminance DB2 may be about 4 nits.

At a first time point t1 of the first frame F1, the i-th emission control signal Ei may be shifted from a gate-on voltage to a gate-off voltage and the fifth and sixth transistors T5 and T6 may be turned off. The gate-off voltage of the i-th emission control signal Ei may be maintained until a sixth time point t6. A period from the first time point t1 to the sixth time point t6 may be defined as a non-emission period of the first frame F1. The remaining period of the first frame F1 excluding the non-emission period may be a light emission period. The i-th emission control signal Ei may be shifted from the gate-off voltage to the gate-on voltage at the sixth time point t6.

Thereafter, at a second time point t2, the (i−1)th scan signal Si−1 may be shifted from the gate-off voltage to the gate-on voltage, and the fourth and seventh transistors T4 and T7 may be turned on. The gate-on voltage of the (i−1)th scan signal Si−1 may be maintained until a third time point t3. At this time, the gate voltage of the first transistor T1 and an anode voltage of the light emitting device LED may be initialized. The (i−1)th scan signal Si−1 may be shifted from the gate-on voltage to the gate-off voltage at the third time point t3.

At a fourth time point t4, the i-th scan signal Si may be shifted from the gate-off voltage to the gate-on voltage, and the second and third transistors T2 and T3 may be turned on. The gate-on voltage of the i-th scan signal Si may be maintained until a fifth time point t5. At this time, data may be written into the first transistor T1 and a threshold voltage of the first transistor T1 may be compensated. The i-th scan signal Si may be shifted from the gate-on voltage to the gate-off voltage at the fifth time point t5.

The scan signals Si−1 and Si in the first frame F1 may have a first pulse width PW1 corresponding to the first display luminance DB1.

The (i−1)th scan signal Si−1 and the i-th scan signal Si may be sequentially supplied to the pixel P in the non-emission period of the second frame F2, similarly to the operation in the first frame F1. In the second frame F2, the interval between the second time point t2 and a third time point t3' and the interval between the fourth time point t4 and a fifth time point t5' each may be smaller than the first pulse width PW1. That is, a second pulse width PW2 of the scan signals Si−1 and Si supplied in the second frame F2 may be smaller than the first pulse width PW1. In this case, the interval between the third time point t3' and the fourth time point t4 of the second frame F2 may be greater than the interval between the third time point t3 and the fourth time point t4 of the first frame F1.

A threshold voltage compensation time of the first transistor T1 in the second frame F2 with a relatively low display luminance may be shorter than a threshold voltage compensation time of the first transistor T1 in the first frame F1. Therefore, the gate voltage (or the compensation point) of the first transistor T1 in the second frame F2 may be raised and a step efficiency at low luminance may be improved.

Figure 4A:
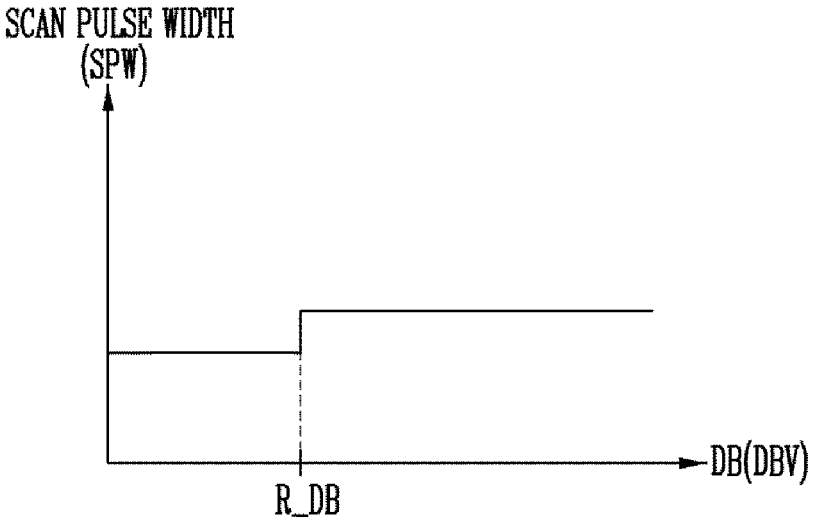
FIGS. 4A, 4B, and 4C are graphs illustrating examples of pulse widths of scan signals determined according to a display luminance.
Figure 4B:
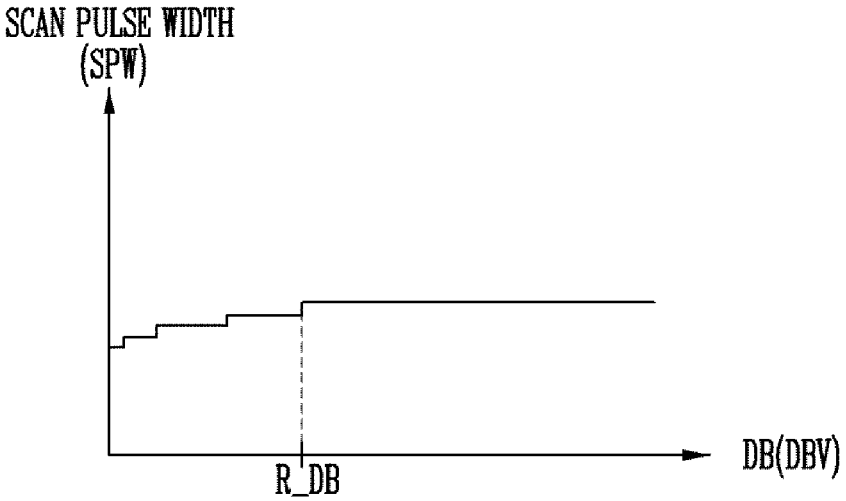
Figure 4C:
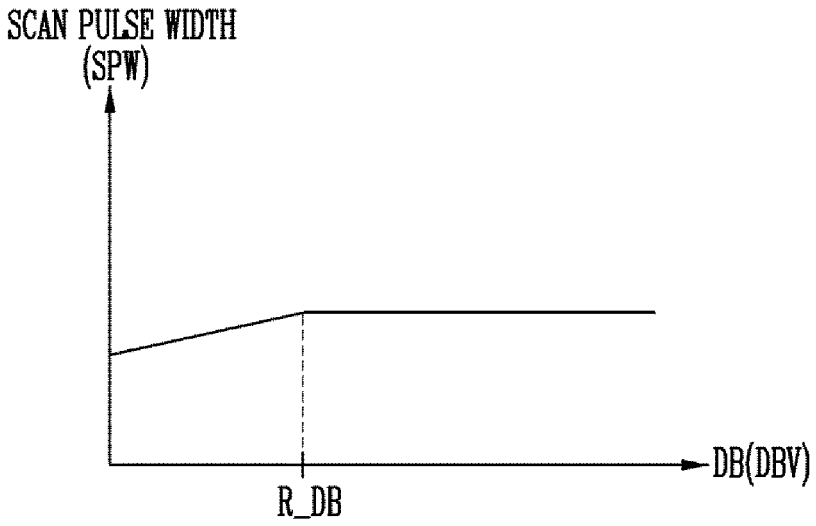

FIGS. 4A, 4B and 4C are graphs illustrating examples of pulse widths of scan signals determined according to a display luminance.

Referring to FIGS. 2, 3, 4A, 4B and 4C, a pulse width SPW of the scan signal may be adjusted according to a display luminance DB and the luminance level DBV.

According to some example embodiments, when the display luminance DB is higher than a reference luminance (e.g., a predetermined reference luminance) R_DB, the scan signal may have the first pulse width (e.g., PW1 in FIG. 3). That is, when the display luminance DB is higher than the reference luminance R_DB, the pulse width SPW of the scan signal may not be changed. For example, the reference luminance R_DB may be set to about 100 nits. The reference brightness R_DB is not limited thereto. For example, the reference luminance R_DB may be determined to be a value less than or equal to about 10 nits, which corresponds to a relatively low luminance.

According to some example embodiments, as shown in FIG. 4A, when the display luminance DB is equal to or less than the reference luminance R_DB, the scan signal may have the second pulse width (e.g., PW2 in FIG. 3). The second pulse width PW2 may be shorter than the first pulse width PW1. However, the second pulse width PW2 may have a length of 50% or more of the first pulse width PW1. Thus, a minimum threshold voltage compensation period required may be ensured.

According to some example embodiments, when the display luminance DB is equal to or lower than the reference luminance R_DB, the pulse width SPW of the scan signal may be decreased as the display luminance DB decreases. For example, as shown in FIG. 4B, the pulse width SPW of the scan signal may be gradually decreased corresponding to a predetermined display luminance DB. In this case, as the display luminance DB is lowered, a cycle of changing the pulse width SPW of the scan signal may be shortened. In another embodiment, as shown in FIG. 4C, the pulse width SPW of the scan signal may be linearly reduced as the display luminance DB decreases. Accordingly, the pulse width SPW of the scan signal may be determined adaptively to the display luminance DB.

However, the pulse width SPW of the scan signal according to the display luminance DB is not limited thereto. A minimum pulse width of the scan signal may be set so as not to be less than 40 to 50% of a maximum pulse width of the scan signal. For example, when the maximum pulse width of the scan signal is about 4.5 μm, the minimum pulse width of the scan signal may be about 2 μm.

As described above, the display device according to some example embodiments of the present invention may improve the step efficiency at a low luminance by reducing the pulse width SPW of the scan signal in correspondence with the low luminance.

Figure 5:
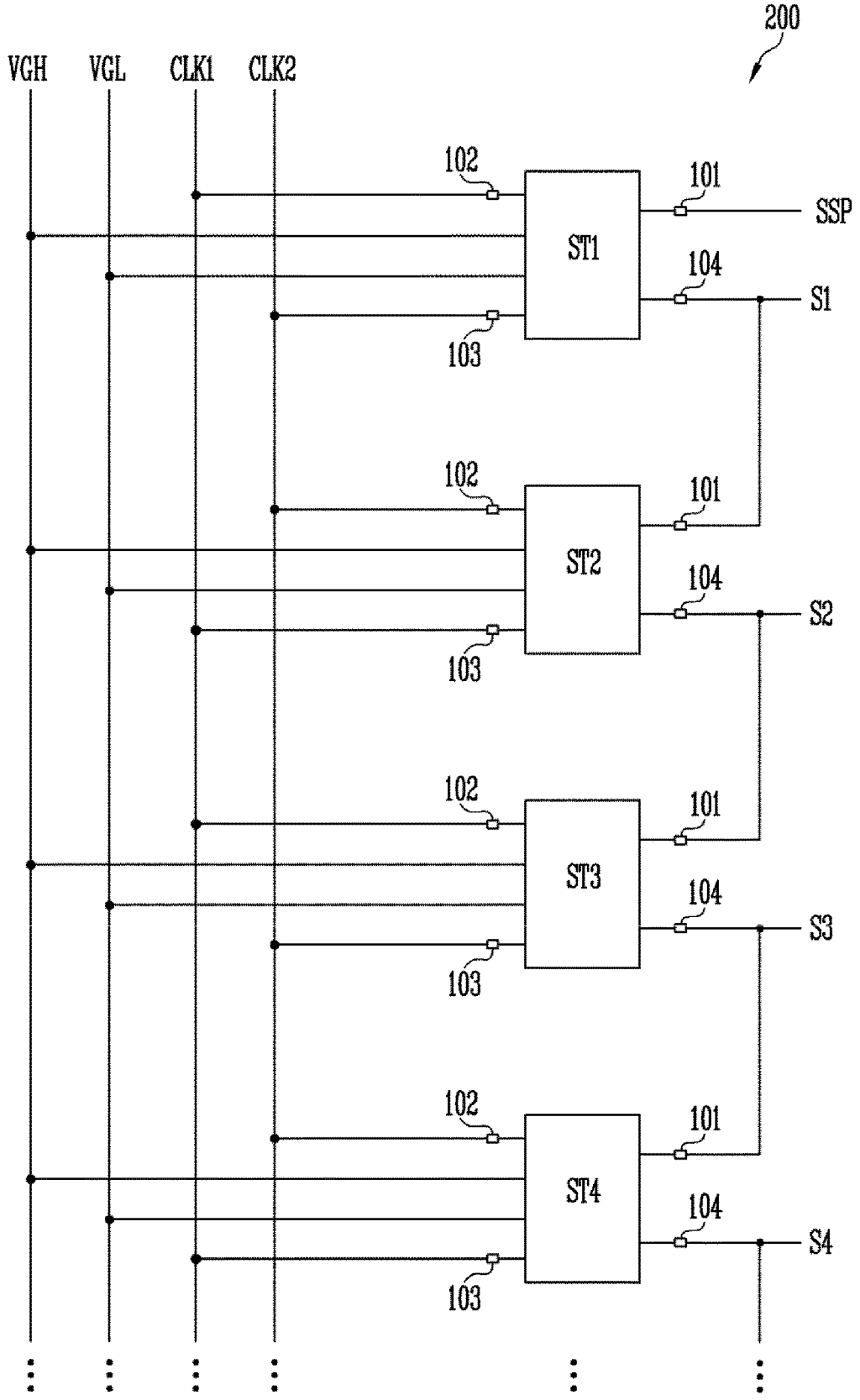
FIG. 5 is a block diagram illustrating an example of a scan driver included in the display device of FIG. 1.

FIG. 5 is a block diagram illustrating an example of a scan driver included in the display device of FIG. 1.

Referring to FIG. 5, the scan driver 200 may include a plurality of stages ST1 to ST4. Each of the first to fourth stages ST1 to ST4 may be connected to each of the first to fourth scan lines and may be driven corresponding to clock signals CLK1 and CLK2. Such stages ST1 to ST4 may be configured with substantially the same circuit.

Each of the stages ST1 to ST4 may include a first input terminal 101, a second input terminal 102, a third input terminal 103, and an output terminal 104.

The first input terminal 101 may receive an output signal of a previous stage (e.g., a scan signal) or the scan start signal SSP. For example, the first input terminal 101 of the first stage ST1 may receive the scan start signal SSP and the first input terminal 101 of the second stage ST2 may receive a scan signal S1 output from the first stage ST1.

According to some example embodiments, the second input terminal 102 of a k-th stage (k is a natural number smaller than n) may receive the first clock signal CLK1 and a third input terminal 103 may receive the second clock signal CLK2. On the other hand, the second input terminal 102 of a (k+1)th stage may receive the second clock signal CLK2 and the third input terminal 103 may receive the first clock signal CLK1.

The first clock signal CLK1 and the second clock signal CLK2 may have the same period and phases which do not overlap with each other. That is, the gate-on periods of the first and second clock signals CLK1 and CLK2 may not be overlapped to each other. For example, when a period during which a scan signal is supplied to one scan line is one horizontal period 1H, the clock signals CLK1 and CLK2 each may have a period of 2H and may be supplied in different horizontal periods.

Although FIG. 5 shows that two clock signals are supplied to the scan driver 200, the number of clock signals supplied to the scan driver 200 is not limited thereto. For example, three or more clock signals may be provided to the scan driver 200 according to a configuration of the stage.

In addition, the stages ST1 to ST4 may be supplied with a first voltage VGL and a second voltage VGH. The first voltage VGL and the second voltage VGH may have a DC voltage level. The second voltage VGH may have a higher value than the first voltage VGL.

According to some example embodiments, the first voltage VGL may be set to the gate-on voltage, and the second voltage VGH may be set to the gate-off voltage. For example, when the pixel P and the scan driver 200 are composed of PMOS transistors, the first voltage VGL may correspond to a logic low level and the second voltage VGH may correspond to a logic low level. The first voltage VGL and the second voltage VGH are not limited thereto. For example, the first voltage VGL and the second voltage VGH may be set according to a type of the transistor, a use environment of the display device, and the like.

Figure 6A:
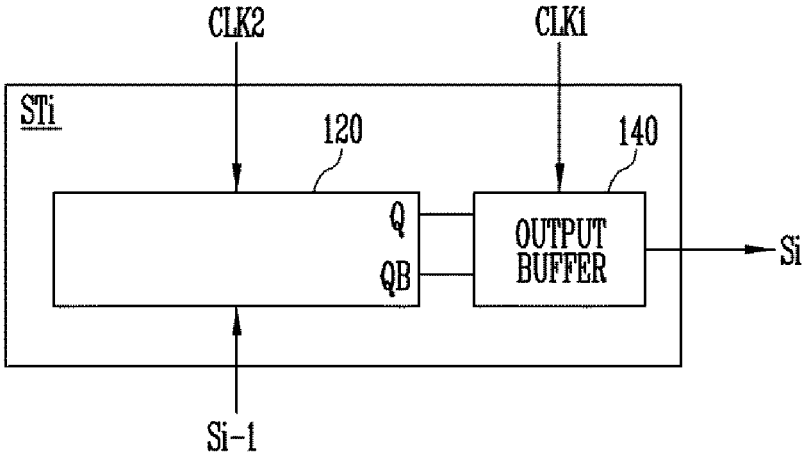
FIG. 6A is a block diagram illustrating an example of a stage included in the scan driver of FIG. 5.
Figure 6B:
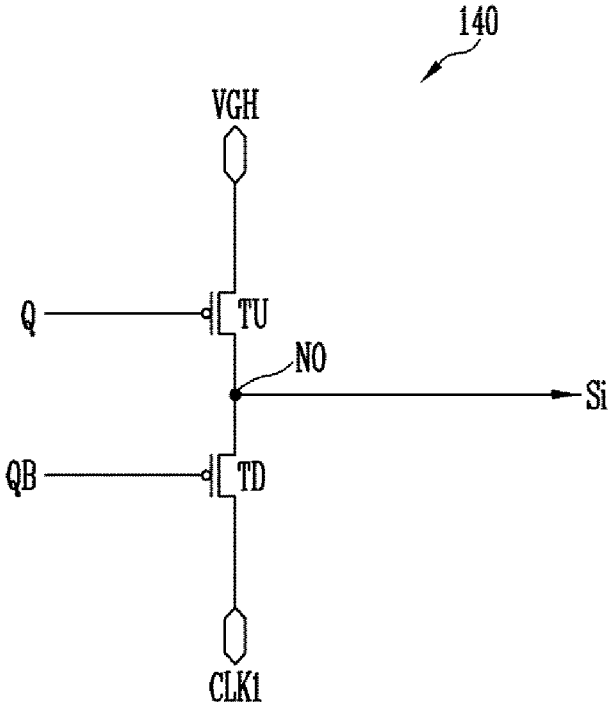
FIG. 6B is a circuit diagram illustrating an example of an output buffer unit included in the stage of FIG. 6A.

FIG. 6A is a block diagram illustrating an example of a stage included in the scan driver of FIG. 5. FIG. 6B is a circuit diagram illustrating an example of an output buffer unit included in the stage of FIG. 6A.

Referring to FIGS. 5, 6A and 6B, an i-th stage STi may include a node control unit 120 and an output buffer unit 140, wherein i is a natural number of n or less.

The node control unit 120 may include a plurality of transistors and at least one capacitor for controlling voltages of first and second nodes Q and QB in response to an output signal (for example, the (i−1)th scan signal Si−1 or an (i−1)th carry signal) of the previous stage. The node control unit 120 may supply the gate-off voltage to the first node Q and supply the gate-on voltage to the second node QB in response to the (i−1)th scan signal Si−1 and the second clock signal CLK2.

The output buffer unit 140 may receive one of the first and second clock signals CLK1 and CLK2 provided from the timing controller 500.

The output buffer unit 140 may apply the first clock signal CLK1 to an output terminal NO when a voltage of the second node QB has the gate-on voltage. The output buffer unit 140 may raise a voltage of the output terminal NO to the gate-off voltage when the voltage of the second node QB rises. For example, the output buffer unit 140 may include a pull-up transistor TU and a pull-down transistor TD, as shown in FIG. 6B.

The pull-up transistor TU may be turned on or turned off according to a voltage state of the first node Q and may apply the second voltage VGH to the output terminal NO when the pull-up transistor TU is in a turn-on state.

The pull-down transistor TD may be turned on or turned off according to a voltage state of the second node QB and may apply the first clock signal CLK1 to the output terminal NO when the pull-down transistor TD is in a turn-on state.

The gate-on periods of the first and second clock signals CLK1 and CLK2 may be changed according to the luminance level DBV (or the display luminance). For example, the gate-on periods of the first and second clock signals CLK1 and CLK2 may have a first pulse width corresponding to the first display luminance and the gate-on periods of the first and second clock signals CLK1 and CLK2 may have a second pulse width corresponding to the second display luminance lower than the first display luminance. The second pulse width may be shorter than the first pulse width.

The scan driver 200 may determine the pulse widths of the scan signals S1 to S4 based on widths of the gate-on periods of the first and second clock signals CLK1 and CLK2 supplied from the timing controller 500.

Accordingly, when the image is abruptly changed from a low grayscale level to a high grayscale level, the gate voltage of the driving transistor is lowered by reducing a compensation time of the driving transistor (the first transistor T1 in FIG. 2) of the pixel. That is, a driving current of the driving transistor is increased. Therefore, the step efficiency at a time of conversion from a low grayscale level image to a high grayscale level image may be improved.

Figure 7:
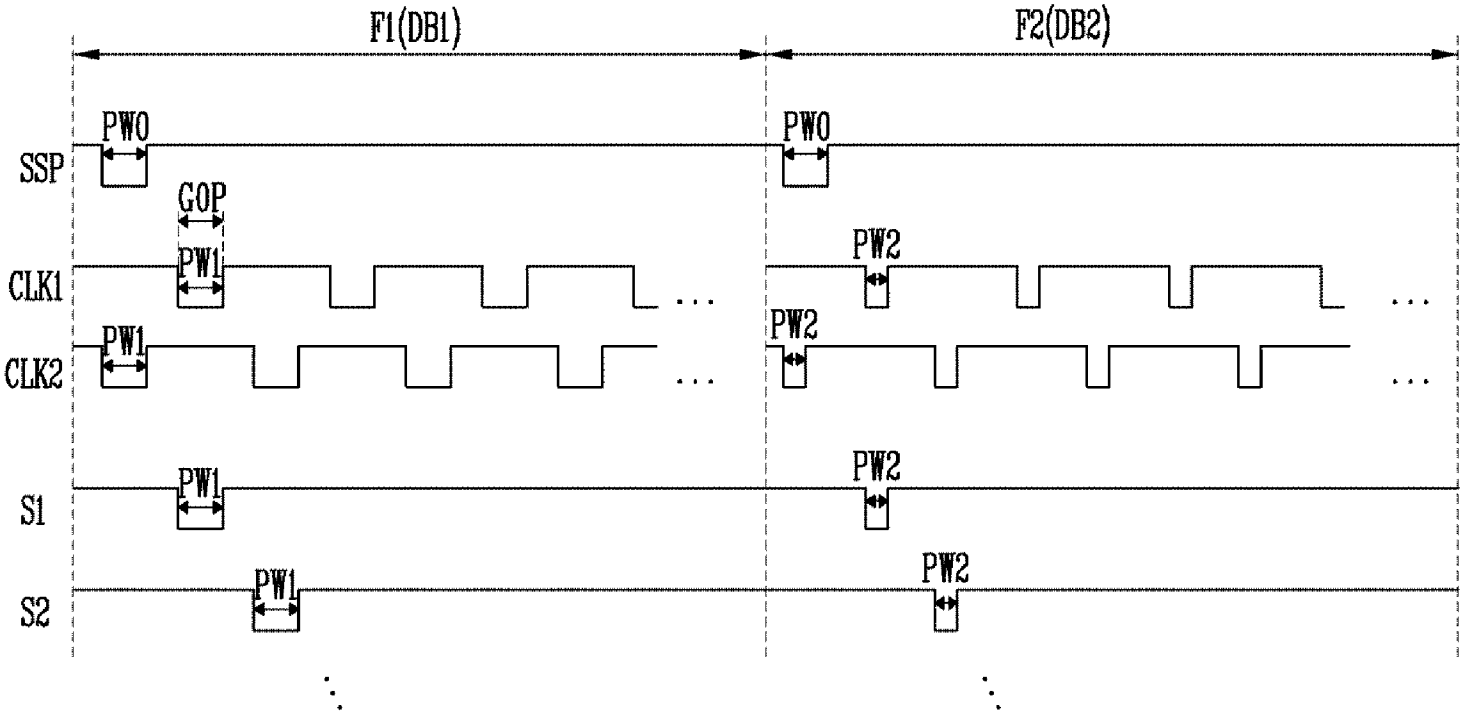
FIG. 7 is a timing chart illustrating an example of an operation of the scan driver of FIG. 5.

FIG. 7 is a timing chart illustrating an example of an operation of the scan driver of FIG. 5.

The timing chart of this embodiment is substantially the same as the timing chart of FIG. 3 except that outputs of the scan signals by the clock signals CLK1 and CLK2 are shown. Therefore, the same reference numerals denote the same or corresponding constituent elements, and redundant explanations are omitted.

Referring to FIGS. 1, 5, 6A, 6B, and 7, the pulse widths of the scan signals S1 and S2 of the first frame F1 and the second frame F2 may be different from each other. In addition, the pulse widths (gate-on periods GOP) of the first and second clock signals CLK1 and CLK2 in the first frame F1 and the second frame F2 may be different from each other.

The display device 1000 in the first frame F1 may emit light with the first display luminance DB1 and the display device 1000 in the second frame F2 may emit light with the second display luminance DB1 lower than the first display luminance DB1. The scan start signal SSP may be supplied to the scan driver 200 with a constant pulse width PW0 irrespective of the display luminance.

The scan signals S1 and S2 may be output in synchronization with the gate-on periods GOP of the first or second clock signals CLK1 and CLK2.

The timing controller 500 may output the clock signals CLK1 and CLK2 having the gate-on periods GOP of the first pulse width PW1 corresponding to the first display luminance DB1 and may output the clock signals CLK1 and CLK2 having the gate-on periods GOP of the second pulse width PW2 corresponding to the second display luminance DB1. The second pulse width PW2 may be shorter than the first pulse width PW1.

During the first frame F1, the scan driver 200 may sequentially apply the scan signals S1 and S2 having the first pulse width PW1 in synchronization with the gate-on period GOP of the first clock signal CLK1 or the second clock signal CLK2. During the second frame F2, the scan driver 200 may sequentially apply the scan signals S1 and S2 having the second pulse width PW2 in synchronization with the gate-on period GOP of the first clock signal CLK1 or the second clock signal CLK2.

According to some example embodiments, the width of the gate-on period GOP of the clock signals CLK1 and CLK2 may be decreased as the display luminance decreases.

In this manner, the gate-on periods GOP of the clock signals CLK1 and CLK2 supplied to the scan driver 200 may be changed according to a change of the display luminance.

Figure 8:
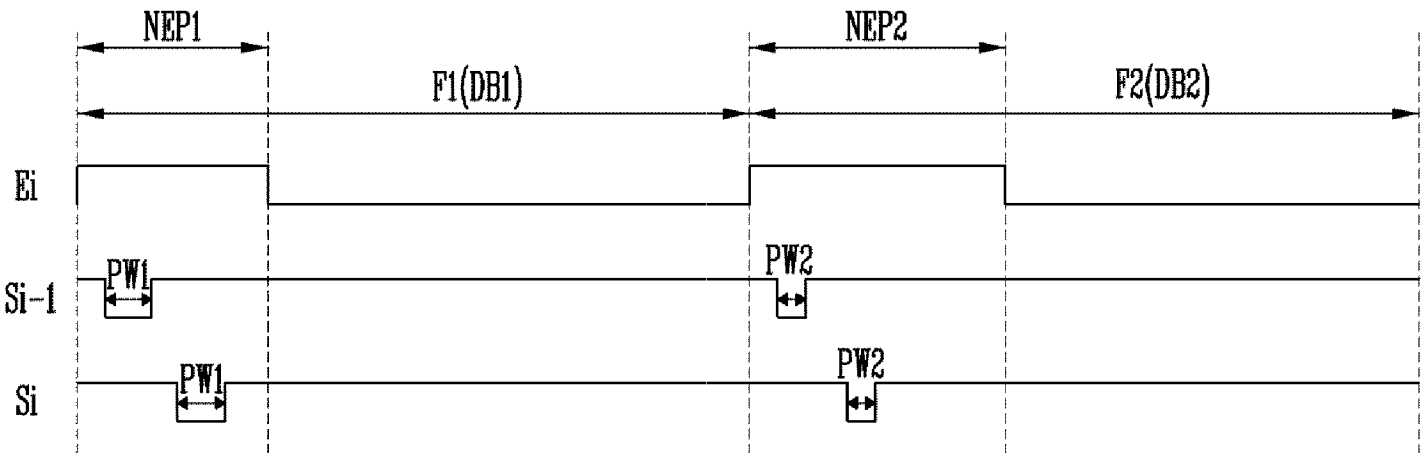
FIG. 8 is a timing chart illustrating an example of signals supplied to the pixel of FIG. 2.

FIG. 8 is a timing chart illustrating an example of signals supplied to the pixel of FIG. 2.

The timing chart of this embodiment is substantially the same as the timing chart of FIG. 3 except that the gate-off period (the non-emission period) of the emission control signal varies according to the display luminance (the luminance level). Therefore, the same reference numerals denote the same or corresponding constituent elements, and redundant explanations are omitted.

Referring to FIGS. 1 and 8, the pulse widths of the scan signals Si−1 and Si in the first frame F1 and the second frame F2 may be different from each other. The display device 1000 in the first frame F1 may emit light with the first display luminance DB1 and the display device 1000 in the second frame F2 may emit light with the second display luminance DB1 lower than the first display luminance DB1.

According to some example embodiments, when the display luminance (or the luminance level DBV) is equal to or less than the predetermined reference luminance, the gate-off period (i.e., non-emission periods NEP1 and NEP2) of the emission control signal Ei may be varied according to the display luminance. That is, when the display luminance is equal to or lower than the reference luminance, the display luminance may be determined according to the widths of the non-emission periods NEP1 and NEP2 of the emission control signal Ei.

For example, the first non-emission period NEP1 corresponding to the first display luminance DB1 may be shorter than the second non-emission period NEP2 corresponding to the second display luminance DB2. In addition, the first pulse width PW1 of the scan signals Si−1 and Si corresponding to the first display luminance DB1 may be larger than the second pulse width PW2 of the scan signals Si−1 and Si corresponding to the second display luminance DB2.

As shown in FIG. 8, as the display luminance decreases, the pulse width of the scan signals Si−1 and Si may be decreased and the width of the non-emission period (the gate-off period) of the emission control signal Ei may be increased.

As described above, in the display device according to some example embodiments of the present invention, the driving current of the pixel may be increased by reducing the pulse width of the scan signal supplied to the pixel as the display luminance decreases. Thus, the step efficiency and the image quality at the time of changing the image from the low grayscale level to the high grayscale level may be improved.

The foregoing description is intended to illustrate and describe aspects of some example embodiments of the present invention. In addition, the foregoing is merely illustrative and explanatory of some example embodiments of the present invention, and as described above, the present invention may be used in various other combinations, modifications, and environments. Changes or modifications may be made within the scope of the inventive concepts disclosed herein, within the scope of equivalents to those described and/or within the skill or knowledge of those skilled in the art. Accordingly, the foregoing description of the invention is not intended to limit the invention to the embodiments disclosed. In addition, the appended claims, and their equivalents, should be construed to include other embodiments.

What is claimed is:

1. A display device comprising:

a display panel including a plurality of pixels;

a scan driver configured to supply a scan signal to a corresponding pixel of the pixels through a scan line to write a data signal to the corresponding pixel; and a timing controller configured to control a pulse width of the scan signal supplied to the corresponding pixel according to an overall display luminance of the display panel.

2. The display device of claim 1, wherein the scan driver is configured to output the scan signal having a first pule width corresponding to a first display luminance and to output the scan signal having a second pule width corresponding to a second display luminance lower than the first display luminance.

3. The display device of claim 2, wherein the second pulse width is shorter than the first pulse width.

4. The display device of claim 1, wherein the pulse width of the scan signal is decreased as the display luminance decreases.

5. The display device of claim 1, wherein the scan driver is configured to output the scan signal having a first pulse width in response to the display luminance being higher than a predetermined reference luminance.

6. The display device of claim 5, wherein the scan driver is configured to output the scan signal having a second pulse width shorter than the first pulse width in response to the display luminance being equal to or lower than the predetermined reference luminance.

7. The display device of claim 5, wherein the pulse width of the scan signal is varied in response to the display luminance being equal to or lower than the predetermined reference luminance.

8. The display device of claim 7, wherein the pulse width of the scan signal is decreased as the display luminance decreases in response to the display luminance being equal to or lower than the predetermined reference luminance.

9. The display device of claim 1, wherein the scan driver is configured to determine the pulse width of the scan signal based on a width of a gate-on period of a clock signal supplied from the timing controller.

10. The display device of claim 9, wherein the timing controller is configured to output the clock signal having the gate-on period of a first pulse width corresponding to a first display luminance and to output the clock signal having the gate-on period of a second pulse width corresponding to a second display luminance lower than the first display luminance.

11. The display device of claim 10, wherein the second pulse width is shorter than the first pulse width.

12. The display device of claim 9, wherein the width of the gate-on period of the clock signal is decreased as the display luminance decreases.

13. The display device of claim 9, wherein the timing controller is configured to convert the display luminance into a luminance level of a digital value and to output the clock signal having the gate-on period corresponding to the luminance level.

14. The display device of claim 1, further comprising:

a data driver configured to supply the data signal to the corresponding pixel through a data line; and an emission driver configured to supply an emission control signal to the corresponding pixel through an emission control line.

15. The display device of claim 14, wherein a gate-off period of the emission control signal is varied according to the display luminance in response to the display luminance being equal to or lower than a predetermined reference luminance.

16. The display device of claim 15, wherein the display luminance is decreased as a width of the gate-off period of the emission control signal increases in response to the display luminance being equal to or lower than the predetermined reference luminance.

* * * * *